US008813384B2

(12) United States Patent
Correll, Jr. et al.

(10) Patent No.: US 8,813,384 B2
(45) Date of Patent: Aug. 26, 2014

(54) HAIR DRYER WITH DUAL AXIS ROTATABLE HANDLE

(75) Inventors: Carroll B. Correll, Jr., Winchester, VA (US); Henry J. Sanders, Woodbridge, VA (US)

(73) Assignee: Paradigm Style, LLC., Winchester, VA (US)

( * ) Notice: Subject to any disclaimer, the term of this patent is extended or adjusted under 35 U.S.C. 154(b) by 691 days.

(21) Appl. No.: 13/178,317

(22) Filed: Jul. 7, 2011

(65) Prior Publication Data

US 2013/0008043 A1 Jan. 10, 2013

(51) Int. Cl.
*A45D 20/12* (2006.01)

(52) U.S. Cl.
CPC ..... *A45D 20/12* (2013.01)
USPC ..... 34/97; 34/96; D28/16

(58) Field of Classification Search
USPC ..... 34/96, 97; D28/16
See application file for complete search history.

(56) References Cited

U.S. PATENT DOCUMENTS

| | | | | |
|---|---|---|---|---|
| 2,691,498 A | | 10/1954 | McCarron | |
| 3,132,232 A | * | 5/1964 | Freedman et al. | 392/384 |
| D231,573 S | | 4/1974 | Ono et al. | |
| 3,846,047 A | | 11/1974 | Wada et al. | |
| 3,986,272 A | | 10/1976 | Feierabent | |
| D251,809 S | | 5/1979 | Harigai | |
| D251,857 S | | 5/1979 | Harigai | |
| D253,012 S | | 9/1979 | Rakocy et al. | |
| 4,197,448 A | | 4/1980 | Harigai | |
| 4,603,246 A | | 7/1986 | Costa | |
| 4,636,613 A | | 1/1987 | de la Morandiere | |

(Continued)

FOREIGN PATENT DOCUMENTS

| | | |
|---|---|---|
| DE | 31 01933 A1 | 9/1982 |
| GB | 2 227 655 A | 8/1990 |

(Continued)

OTHER PUBLICATIONS 421 405, Mar. 31, 1967, Hauptpatent, Solis Apparatefabriken AG, Zurich, Als Handgerat ausgebildeter Haartrockner, Fritz Schaufelberger, Zurich, ist als Erfinder genannt worden.

*Primary Examiner* — Kenneth Rinehart
*Assistant Examiner* — Gajanan M Prabhu
(74) *Attorney, Agent, or Firm* — Roberts Mlotkowski Safran & Cole P.C.

(57) ABSTRACT

A hair dryer is provided having a handle that may both be pivoted toward the dryer housing, and rotated with respect to the dryer housing so that the dryer may easily be operated in either a handle-held or nozzle-held mode. The hair dryer includes a dual axis joint assembly connecting the handle to the dryer housing that allows the handle to be rotated around its longitudinal axis before or during the time it is pivoted toward the dryer housing so that the control switch remains exposed and operable by a user when the handle is pivotally folded against the dryer body in preparation for nozzle-held operation. The dual axis joint assembly may include an eccentric mechanism that converts pivoting movement of the handle toward and away from said housing into rotational movement of said handle so that the handle turns 90° when pivotally folded against the dryer housing. Additionally, the electrical cord connection for supplying power to the blower assembly within the dryer housing is mounted on the blower assembly portion of the housing opposite the nozzle instead of on the handle so that the electrical cord does not interfere with the nozzle held operation of the dryer.

26 Claims, 13 Drawing Sheets

(56) References Cited

U.S. PATENT DOCUMENTS

| | | | | | |
|---|---|---|---|---|---|
| D294,873 | S | | 3/1988 | Ogawa et al. | |
| D301,231 | S | | 5/1989 | Yoshiharu | |
| 4,977,306 | A | | 12/1990 | Kosaka et al. | |
| D318,347 | S | * | 7/1991 | Hirose et al. | D28/12 |
| 5,526,578 | A | * | 6/1996 | Iyer | 34/97 |
| 5,727,331 | A | | 3/1998 | Thaler et al. | |
| 5,839,204 | A | | 11/1998 | Cinque et al. | |
| 5,884,008 | A | | 3/1999 | Goldberg | |
| 5,956,861 | A | | 9/1999 | Barnes | |
| D434,182 | S | | 11/2000 | Cheung | |
| D439,372 | S | | 3/2001 | Yip | |
| D457,266 | S | * | 5/2002 | Yeung | D28/13 |
| 6,520,467 | B2 | * | 2/2003 | Thomas et al. | 248/309.3 |
| D472,015 | S | * | 3/2003 | Young | D28/13 |
| D502,570 | S | | 3/2005 | Nanbu et al. | |
| D519,242 | S | * | 4/2006 | Lin | D28/13 |
| 8,707,577 | B2 | * | 4/2014 | Lee et al. | 34/97 |

FOREIGN PATENT DOCUMENTS

| | | | |
|---|---|---|---|
| JP | 52-66060 | A | 6/1977 |
| JP | 52-70650 | A | 6/1977 |
| JP | 53-143452 | A | 12/1978 |
| JP | 53-143453 | A | 12/1978 |
| JP | 53-143454 | A | 12/1978 |
| JP | 54-31353 | A | 3/1979 |

* cited by examiner

HAIR DRYER WITH DUAL AXIS ROTATABLE HANDLE

FIELD

This invention generally relates to hair dryers, and is specifically concerned with a hair dryer having a handle that is both pivotable toward the dryer housing and rotatable with respect to the dryer housing.

BACKGROUND

Portable hair dryers are well known in the prior art. Many such hair dryers are pistol-shaped, comprising a dryer housing containing a blower assembly and having a nozzle at one end, and a handle that extends orthogonally from the underside of the dryer housing. Often, several control switches are mounted on the front face of the handle for controlling blower assembly actuation and the flow rate and the amount of heating applied to the air stream. In use, the user typically grips the handle, actuates and adjusts the blower assembly with the control switches, and scans the nozzle over his or her hair.

Despite the provision of a handle, some users prefer to hold such pistol-shaped dryers by their nozzle during operation. For example, if the user is unable to see the dryer because it is behind their head, or hair is blocking their view, they may be better able to feel where the dryer is pointing when holding the dryer by the nozzle. Also, a person drying someone else's hair, such as a hair stylist, may find a nozzle-holding grip to be more comfortable when standing over a seated person, or when using the dryer for long periods of time. Such a nozzle-holding grip also allows the stylist to achieve a maximum range of dryer movement while maintaining a same standing position relative to the seated person whose hair is being dried.

SUMMARY

While it is possible to operate many pistol-shaped portable hair dryers from a nozzle held position, the applicants have observed a number of problems associated with such operation. For example, since the actuation and control switches are typically mounted on the handle, it is not possible to adjust these control switches from the same fingers gripping the nozzle. To solve this problem, some prior art dryers are provided with a second set of control switches mounted on the dryer housing that can be operated by the same fingers gripping the nozzle. But, while the provision of a second set of control switches on the nozzle of the dryer offers a solution to this problem, it also increases the expense and complexity of the hair dryer.

Additionally, the handle that extends at an approximately 90° angle from the dryer housing interferes with the maneuverability of the dryer when the dryer is used in a nozzle-held mode. While pistol-shaped hair dryers are known that have handles which can be pivotally folded toward the dryer housing, the purpose of such folding handles has been to reduce the size of the hair dryer so that it may be more easily packed and traveled with. Consequently, no concern is given to the operability of the actuation switches that are mounted over the front face of the handle, which are sandwiched into an inaccessible position between the dryer housing and the back portion of the handle when the handle is pivoted into a folded position. Additionally, the electrical cord that powers the blower assembly typically extends out of the bottom of the handle. Consequently, when the handle is pivotally folded into a position parallel with the dryer housing, Such a design causes the electrical cord to project toward the front of the dryer when the handle is pivotally folded into a position parallel with the dryer housing, where it can interfere with both the maneuverability and balance of the dryer.

Clearly, there is a need for a pistol-shaped hair dryer that is capable of being operated in a nozzle-held position without the aforementioned drawbacks. To this end, the hair dryer of the invention comprises a housing containing a blower assembly and including a nozzle having an open end that directs air blown by the blower assembly along an axis, and an electrical cord connection mounted on the blower assembly portion of the housing that supplies power to the blower assembly; an elongated handle having a control switch that controls the blower assembly, the control switch facing a same direction as the nozzle end of the housing and being operable in pistol-grip fashion when the handle is in a position substantially orthogonal to the housing axis, and a dual axis joint assembly connecting the handle to the housing that allows the handle to be rotated around its longitudinal axis, and pivoted from said orthogonal position to a position substantially parallel to said housing axis such that the control switch is exposed and operable by a user when the handle is pivoted into said position substantially parallel to said housing axis.

The dual axis joint assembly allows the handle to be rotated at least 90° such that the control switch faces away from the housing when the handle is pivoted from said orthogonal position to said position substantially parallel to said housing axis. In one embodiment of the inventive hair dryer, the dual axis joint assembly includes an eccentric mechanism that converts pivoting movement of the handle toward and away from said housing into rotational movement of said handle such that the control switch turns away from the housing into a finger-accessible position when the handle is pivoted into said position substantially parallel to said housing axis. In a second embodiment, the dual axis joint assembly allows the handle to be freely rotated between 90° and 180° prior to pivoting the handle toward the dryer housing. Such a freely rotatable handle allows the user to redirect the air stream generated by the blower assembly while gripping the handle in its normal position without turning his or her wrist at an uncomfortable angle. This is a particularly useful feature for a hairdresser standing over a seated customer during a hairdressing procedure, in that it allows the hairdresser to constantly redirect a flow of drying air to the hair of the seated customer at a large number of directions without the need for either continuously walking from one side of the customer to the other or frequently rotating the swivel chair that the customer typically sits in.

In both embodiments, the dual axis joint assembly may include a lock movable into a locking and an unlocking position that prevents the handle from rotating and pivoting relative to the housing when in said locking position, as well as a hand strap connected to the exterior of the housing that receives the fingers of a user to facilitate the grip of a user around the housing.

DETAILED DESCRIPTION OF THE EMBODIMENTS

Figure 1:
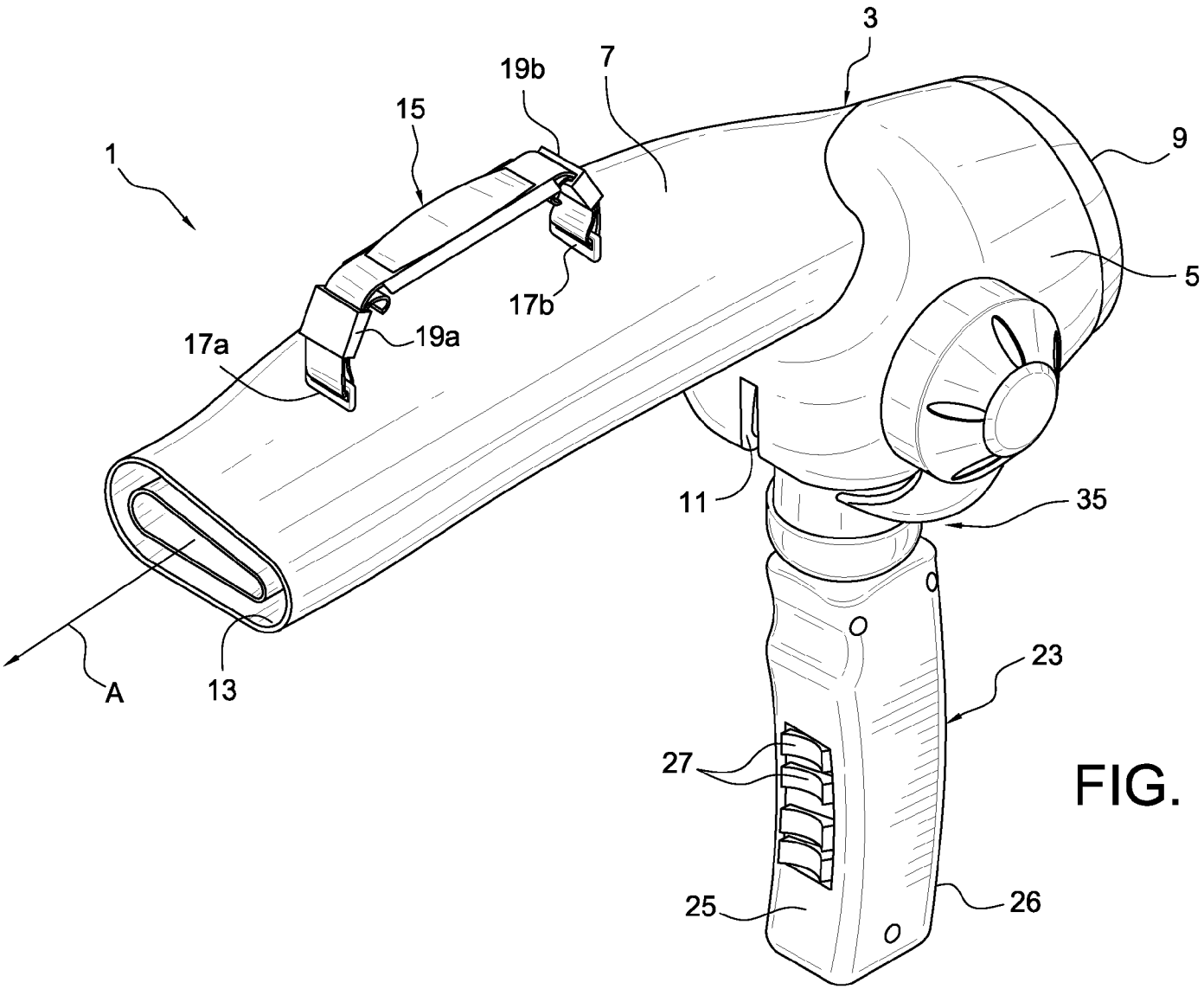
FIG. 1 is a perspective view of a first embodiment of the inventive hair dryer with the handle oriented orthogonally with respect to the dryer housing.
Figure 2:
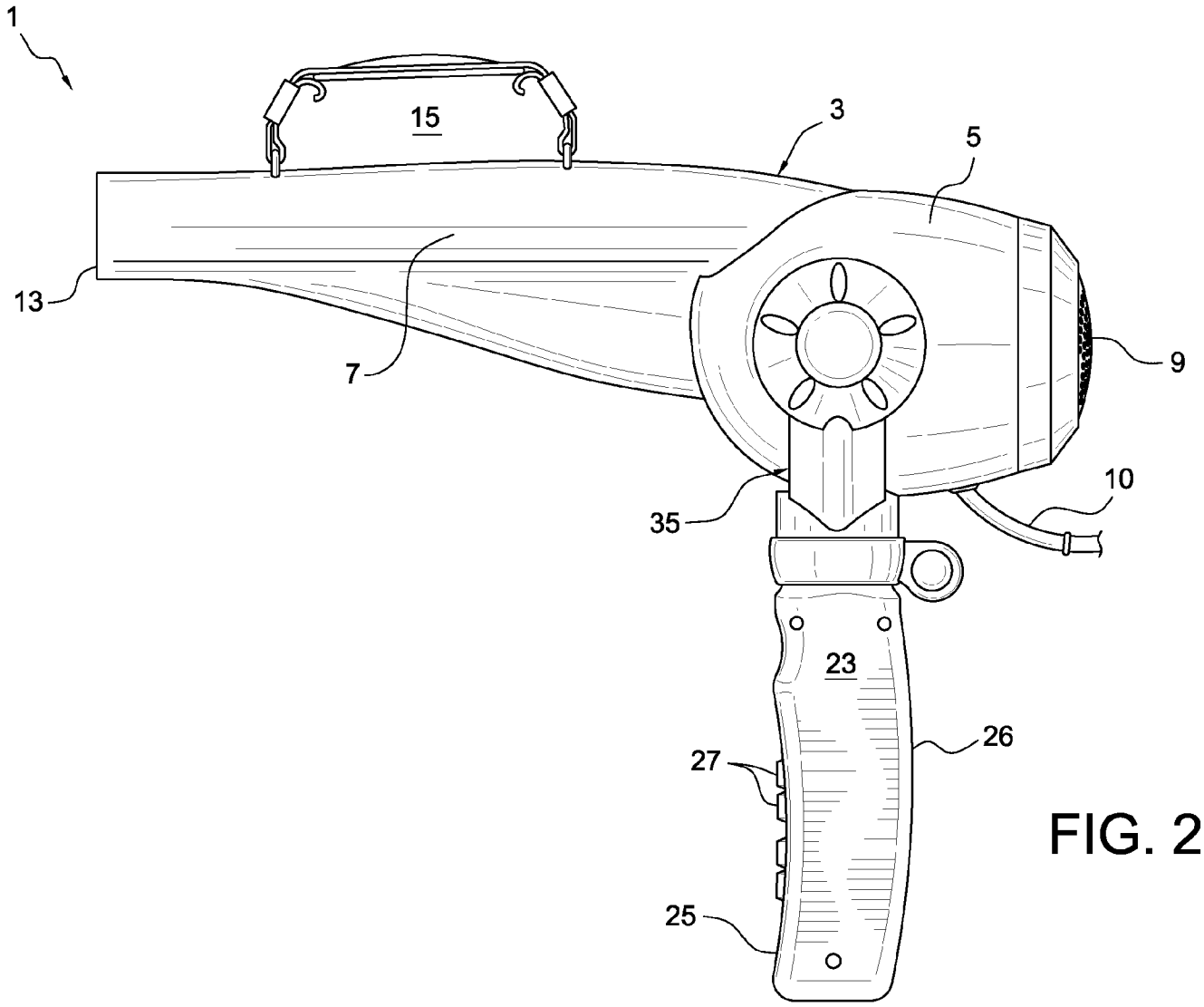
FIG. 2 is a side view of the hair dryer illustrated in FIG. 1.
Figure 3:
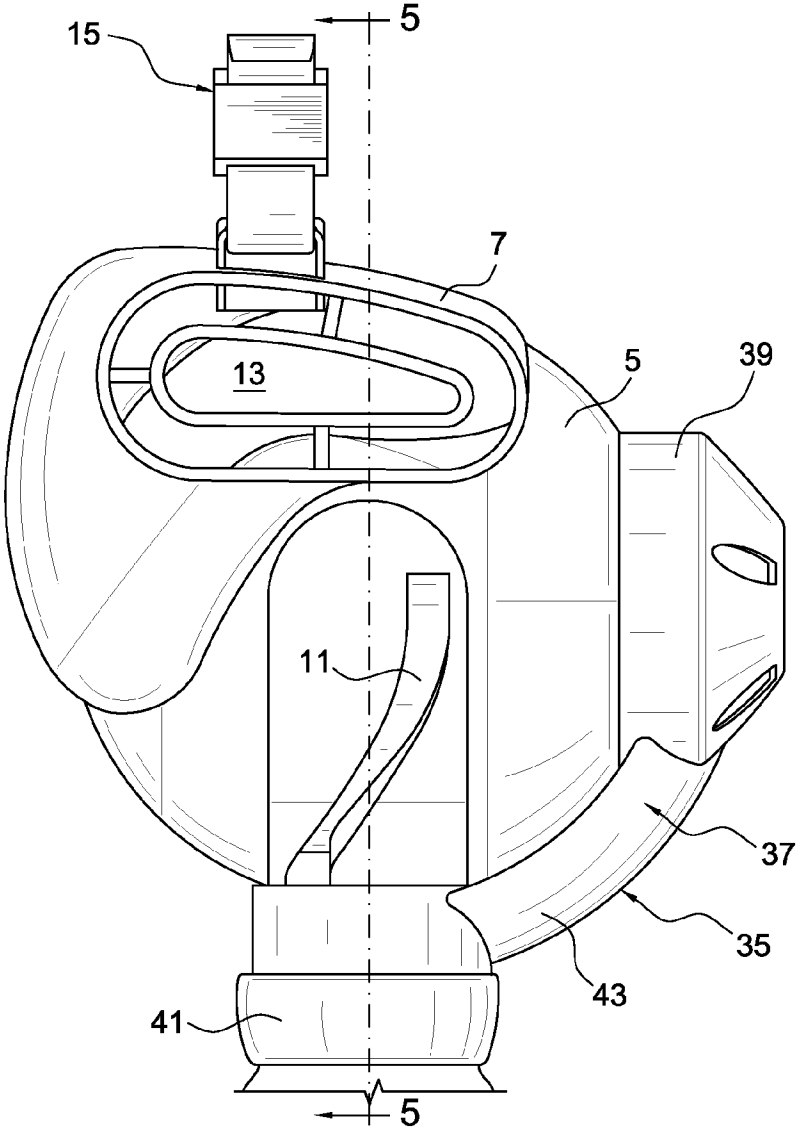
FIG. 3 is a front view of the hair dryer illustrated in FIG. 1.

With reference now to FIGS. 1-3 and FIG. 5, wherein like numerals designate like components throughout all of the several Figures, the hair dryer 1 of the invention includes a housing 3 having a blower portion 5 for housing a blower assembly 6, and an elongated nozzle 7 that houses heating elements 8. The blower portion 5 includes an air intake 9 at its back portion, an electrical cord connection 10 at its bottom portion (as shown in FIG. 2), and a cam slot 11 in its front portion which forms part of a dual axis joint assembly described hereinafter. The nozzle 7 includes an open end 13 that directs blown air in a direction substantially parallel to the axis "A", and a hand strap 15 mounted on its top portion as shown. Hand strap 15 is mounted on the nozzle by way of strap swivels 17*a*, 17*b*. Strap length is adjustable via length adjusters 19*a*, 19*b*. The hand strap 15 facilitates the of the hair dryer in the nozzle-gripped mode of operation by both securing the dryer to the hand of the operator and aligning the fingers of the operator over the switches of the handle when the handle is pivotally folded toward the housing 3. The handle 23 of the hair dryer 1 is elongated as shown, and includes a front face 25 and a back face 26. Control switches 27 are provided on the front face 25 so that the hair dryer 1 may be operated in "pistol grip" fashion by the fingers of an operator when the dryer is uses in a nozzle-gripped mode. Preferably, the handle 23 is slightly curved along its longitudinal axis as best seen in FIG. 2 to facilitate the grip by an operator.

Figure 4:
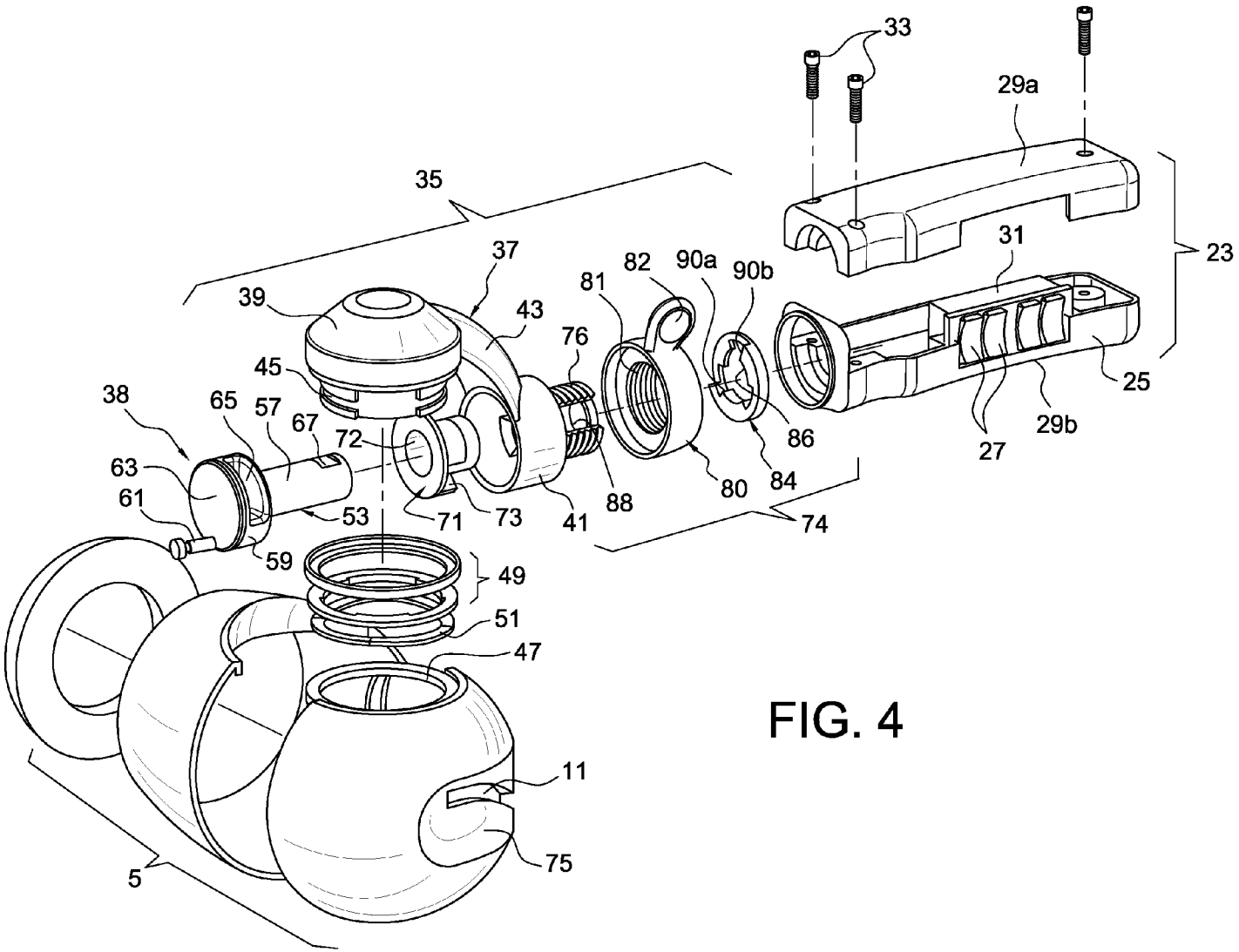
FIG. 4 is a partial exploded view of the hair dryer of FIG. 1 illustrating in particular the dual axis joint assembly that connects the handle to the blower assembly portion of the housing.

With reference now to FIG. 4, the handle 23 is formed from handle halves 29*a* and 29*b*. A switch box 31 containing the control switches 27 is captured between the handle halves 29*a* and 29*b*, which are in turn secured together via mounting screws 33. The handle 23 is connected to the housing 3 by a dual axis joint assembly 35 having a pivoting joint 37 that allows the handle to be pivotally folded toward the housing 3, and a rotary joint 38 that allows the handle 23 to be rotated around its longitudinal axis relative to the housing 3. Unless otherwise stated, all components of the housing 3 and of the joint assembly 35 are preferably formed from a moldable plastic material such as polyurethane. Each of these components of the dual axis joint assembly 35 will now be described in detail.

The pivoting joint 37 of the joint assembly 35 includes a housing hub 39, a handle fitting 41, and an arcuate arm 43 that integrally connects the hub 39 to the fitting 41. The fitting 41 is attached to the handle 23 in a manner that will be described in more detail hereinafter. The housing hub 39 includes a partial annular groove 45 that snap-fits into an annular rim 47 provided in a side wall of the blower assembly portion 5 of the housing 3 in order to rotatably mount the housing hub 39 in the housing 3. A pair of lubricated bushings 49 and a wave compression spring 51 are sandwiched between the housing hub 39 and the annular rim 47 in order to provide a smooth pivoting action between the housing hub 39 and the rim 47 so that the handle 23 attached to the fitting 41 of pivoting joint 37 may be smoothly pivoted toward and away from the housing 3. To this end, the bushings are preferably formed from nylon impregnated with a solid lubricant such as molybdenum disulfide, and the wave spring 51 is formed from carbon steel and has a compression rating of between about 20 and 40 pounds.

Figure 5:
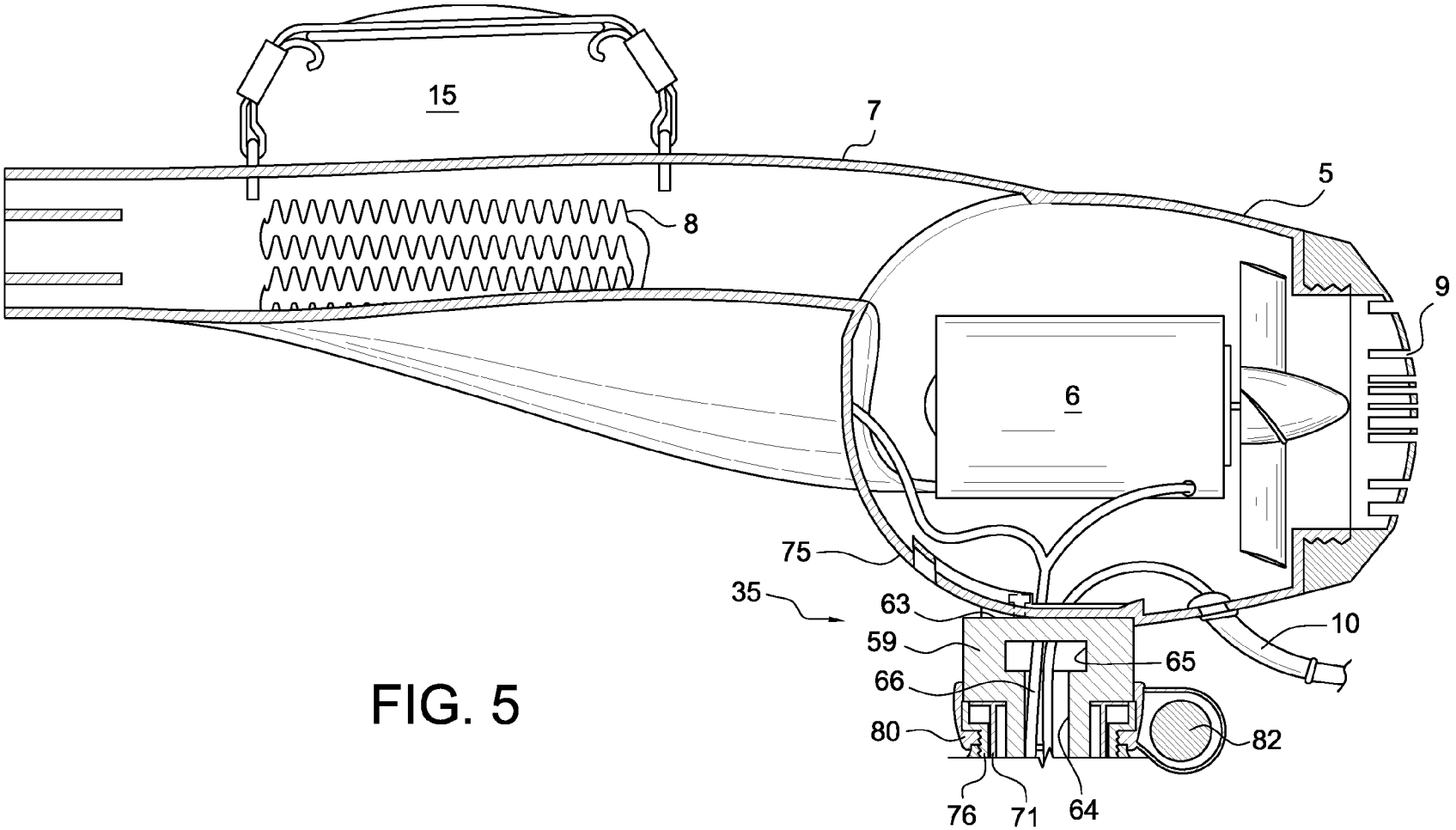
FIG. 5 is a cross-sectional side view of the of the hair dryer taken along the line 5-5 of FIG. 3 illustrating in particular the blower assembly and the electrical cord connection mounted on the blower assembly portion of the housing.

With reference to both FIGS. 4 and 5, the rotary joint 38 of the joint assembly 37 includes an eccentric mechanism in the form of an eccentric shaft assembly 53. Eccentric shaft assembly 53 includes a main shaft 57 integrally connected at one end to a disc-shaped head 59. An off-center shaft 61 is connected to the outer surface 63 of the head 59. Off-center shaft 61 is received within the cam slot 11 in the blower assembly portion 5 of the housing 3 when components illustrated in FIG. 4 are assembled. The interior 64 of the main shaft 57 is hollow and the head 59 includes a slot 65 in order to accommodate wires 66 from the switchbox 31 which control electrical current to the motor of the blower assembly 6 and the electric heating elements. The end of the main shaft 57 opposite the head 59 includes a recessed portion 67 that is keyed into a complementary-shaped protrusion (not shown) within the handle half 29*a* is attached to handle half 29*b* so that the handle 23 and the main shaft 57 are affixed to one another and rotate together during operation. The rotary joint 38 further includes a bushing 71 that is received within the interior of the handle fitting 41. Bushing 71 includes a cylindrical interior 72 that rotatably receives the main shaft 57 of the eccentric shaft assembly 53. Bushing 71 also includes a flange 73 that is keyed into a complementarily-shaped slot (not shown) in the fitting 41 so that the bushing 71 cannot rotate relative the fitting 41.

Finally, the dual axis joint assembly 35 includes a brake mechanism 74 for selectively increasing the frictional engagement between the outer surface 63 of the head 59 of the eccentric shaft assembly 53 and an engagement surface 75 on the blower assembly portion 5 of the housing 3. Brake mechanism 74 is formed from the combination of a threaded sleeve 76 that forms an integral part of the handle fitting 41, and a compression collar 80. The compression collar 80 has a threaded interior 81 engageable with the threads of the sleeve 76, and a thumb wing 82 extending from one side to facilitate rotation of the collar 80 by the operator. The brake mechanism 74 also includes a ring-shaped collar limiter 84 that limits the rotation of the collar 80 to an arc of about 112°. The collar limiter 84 includes a protrusion 86 on its inner diameter that keys this component to a slot 88 in the threaded sleeve 76 of the handle fitting 41 so that this component remains stationary relative to the compression collar 80. The collar limiter 84 further includes stop surfaces 90*a*, 90*b* which engage opposite surfaces of a flange (not shown) located at the lower portion of the inner diameter of the compression collar. The pitch of the threads on the threaded sleeve 76 and collar interior 81 is chosen such that the rotation of the compression collar 80 around an arc of 112° pushes the outer surface 63 of the head 59 of the eccentric shaft assembly 53 against the engagement surface 75 of the housing 3 with enough force to frictionally "lock" the handle 23 in any desired angle between the orthogonal position illustrated in FIG. 2 and the completely folded position illustrated in FIG. 6.

Figure 6:
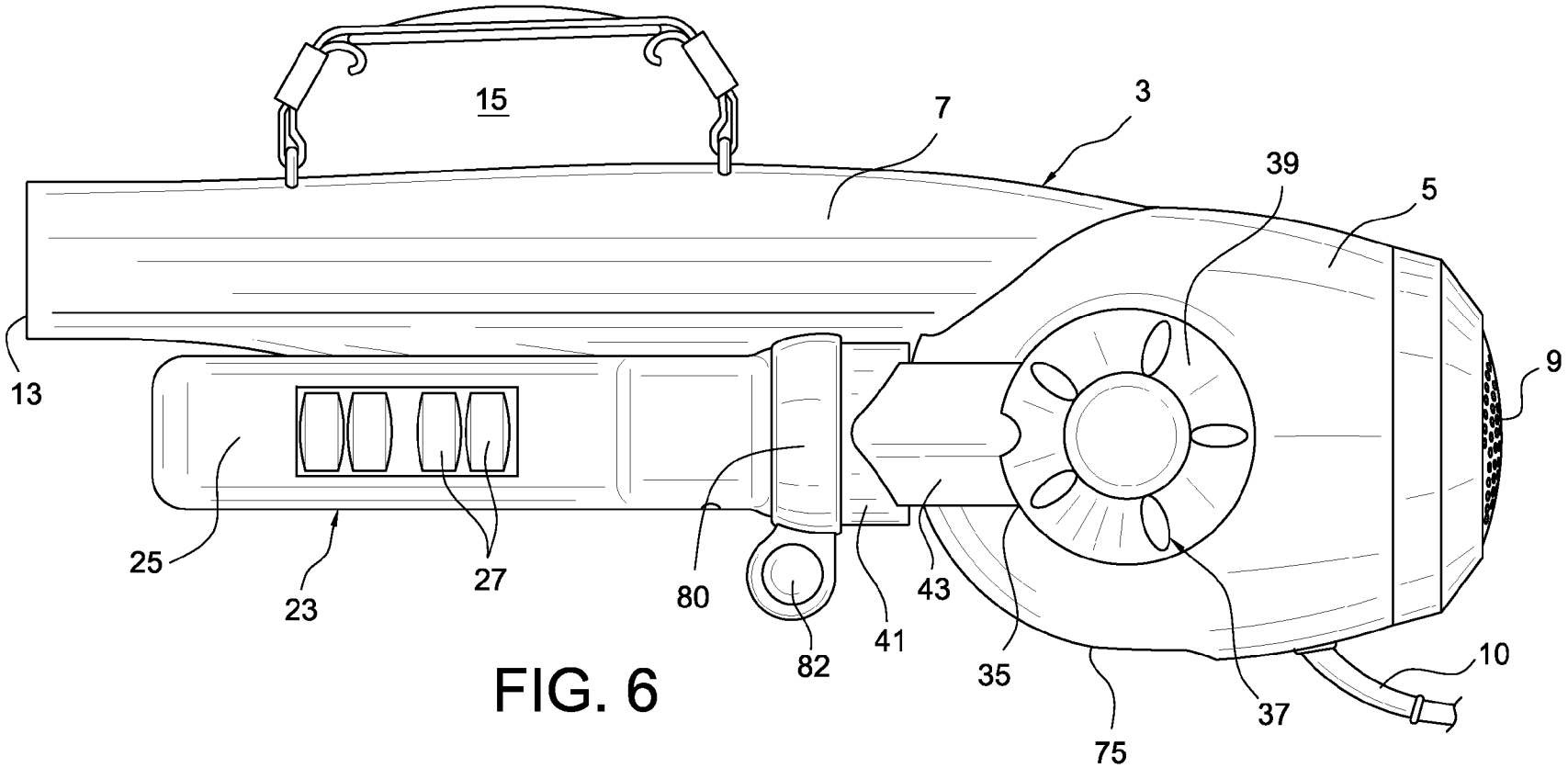
FIG. 6 is a side view of the hair dryer of FIG. 1, illustrating how the control switches on the handle remain accessible when the handle is pivotally folded toward the housing in preparation for a nozzle-held mode of operation.

The operation of the first embodiment 1 of the inventive hair dryer will now be explained with reference to FIGS. 2, 3, 5 and 6. FIG. 2 illustrates the hair dryer 1 in a handle-held mode of operation, wherein the longitudinal axis of the handle 23 is "locked" into an orthogonal orientation with respect to the housing 3 via the brake mechanism 74. When the hair dryer 1 is to be used in a nozzle-held mode, the compression collar 80 of the brake mechanism is rotated via thumb wing 82 to retract the outer surface 63 of the head 59 of the eccentric shaft assembly 53 from the engagement surface 75. This action substantially reduces the frictional force between the surfaces 63 and 75, thereby allowing the head surface 63 to slide over the engagement surface 75 of the housing 3. The handle 23 is then pivoted 90° toward the housing 3, via the pivoting joint 37 of the dual axis joint assembly 35. At the same time, the rotary joint 38 rotates the handle 23 90° around the main shaft 57 of the shaft assembly as a result of the slidable engagement between the off-center shaft 61 of the eccentric shaft assembly 53 and the curve of the cam slot 11 best seen in FIG. 3. Accordingly, when the handle 23 is pivoted 90° into a position substantially parallel to the longitudinal axis A of the nozzle 7, the handle 23 is simultaneously rotated 90° such that the front face 25 of the handle 23 is turned to the left as illustrated in FIG. 6, advantageously exposing the switches 27 located on the front face 25 of the handle and rendering them easy to use. The placement of the electrical cord connection 10 at the lower back of the blower assembly portion 5 of the housing 3 advantageously positions the electrical cord out of the way of the operator during such a nozzle-held mode of operation.

Figure 7:
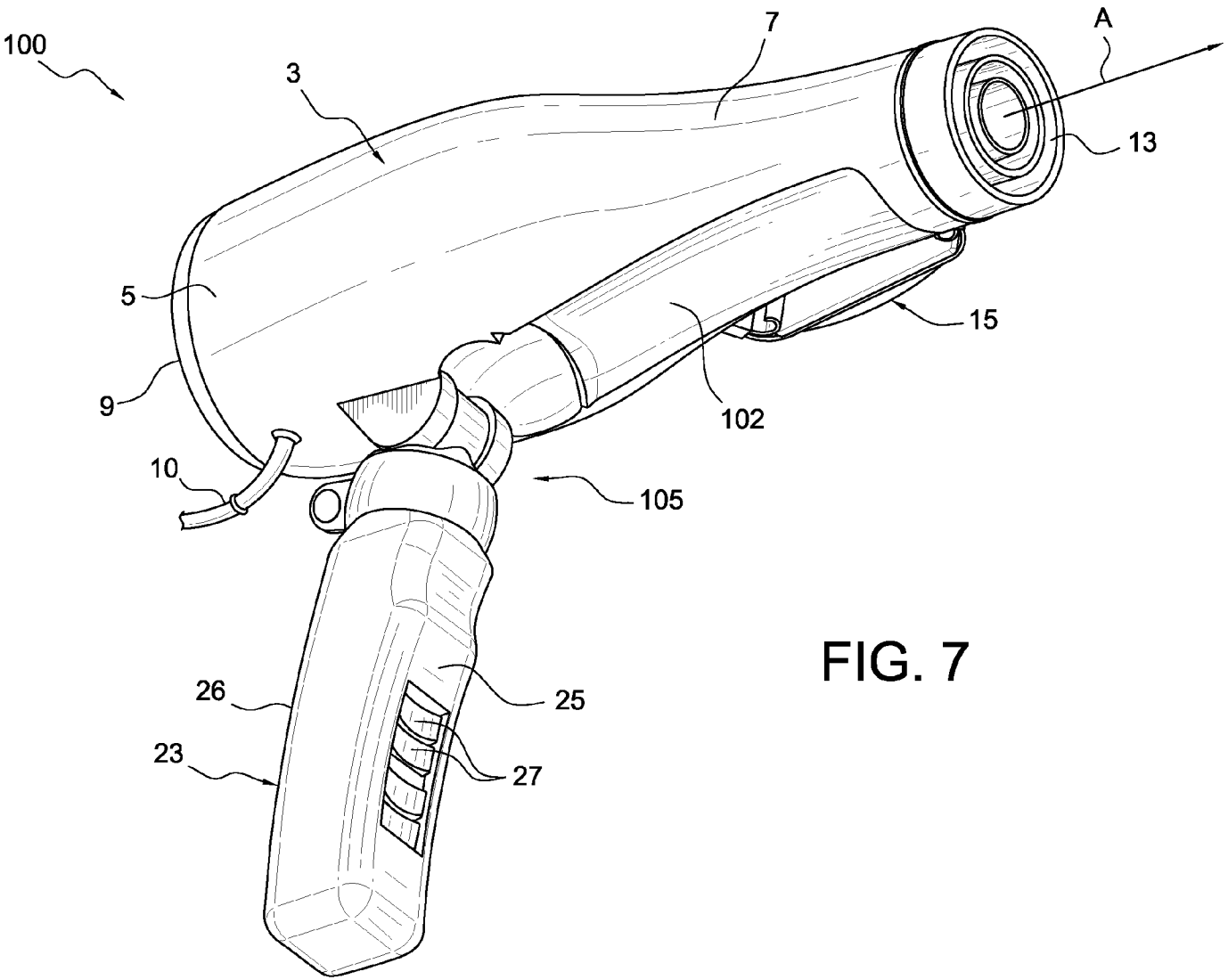
FIG. 7 is a perspective view of a second embodiment of the inventive hair dryer with the handle oriented orthogonally with respect to the dryer housing.
Figure 8:
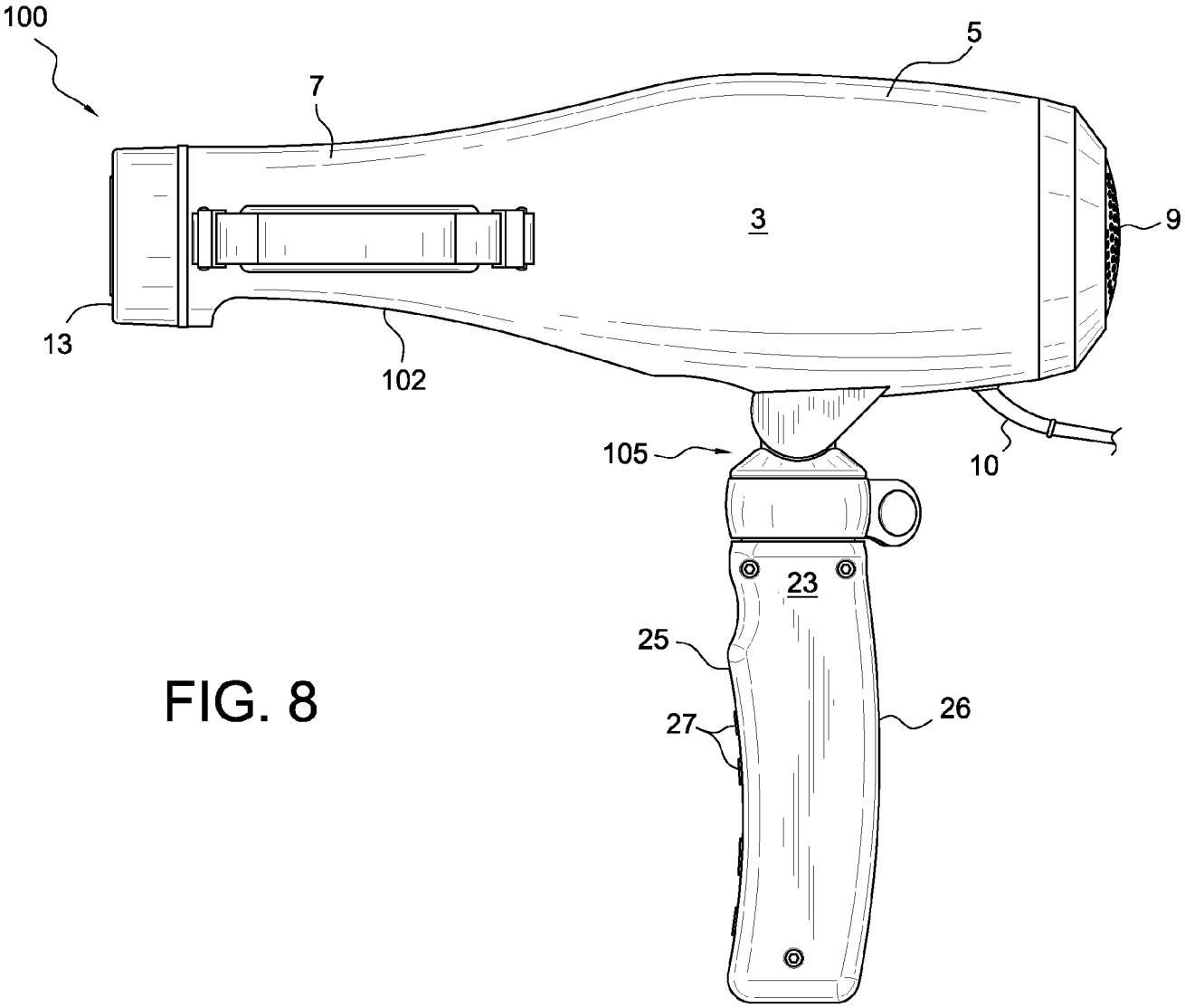
FIG. 8 is a side view of the hair dryer illustrated in FIG. 7.
Figure 10:
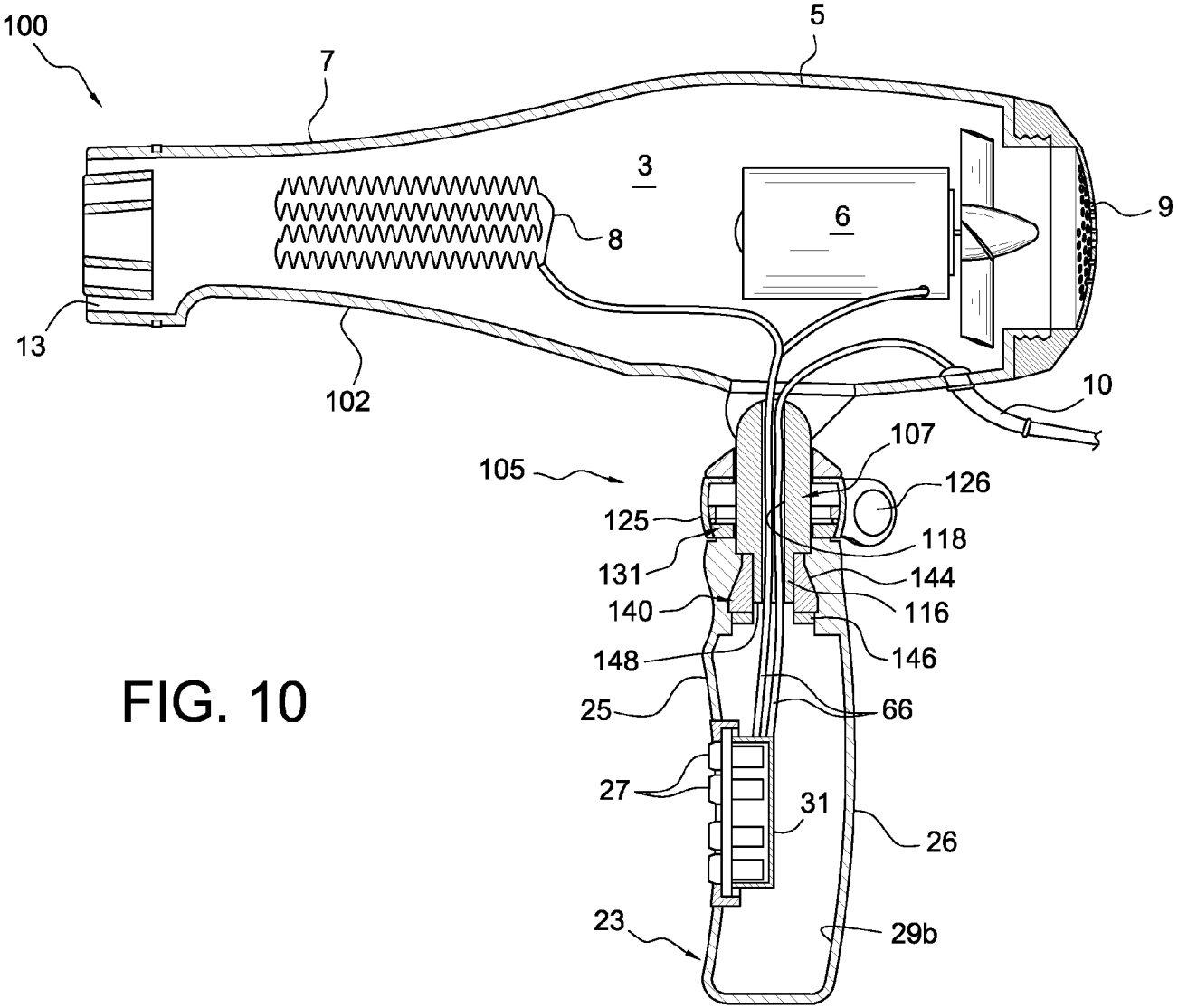
FIG. 10 is a side cross-sectional view of the of the hair dryer of FIG. 7 illustrating in particular the blower assembly and the electrical cord connection mounted on the blower assembly portion of the housing.

FIGS. 7, 8 and 10 illustrate a second embodiment 100 of the hair dryer of the invention. Like the previously-described first embodiment 1, the second embodiment of the invention includes a housing 3 having a blower portion 5 for housing a blower assembly 6, and an elongated nozzle 7 that houses heating elements 8. The blower portion 5 includes an air intake 9 at its back portion, and an electrical cord connection 10 at its bottom portion. The nozzle 7 includes an open end 13 that directs blown air in a direction substantially parallel to the axis "A", and a hand strap 15 mounted on its side portion as shown and having all the adjustment features previously described with respect to the first embodiment 1. The hand strap 15 facilitates the of the hair dryer 100 in the nozzle-gripped mode of operation by both securing the dryer 100 to the hand of the operator and aligning the fingers of the operator over the switches 27 of the handle 23 when the handle 23 is pivotally folded toward the housing 3. Like the first embodiment 1, the handle 23 of the second embodiment is slightly curved along its longitudinal axis as best seen in FIG. 8 to facilitate the grip by an operator. However, unlike the first embodiment 1, the housing 3 of the second embodiment 100 includes a recess 102 for receiving the back face 26 of the handle 23 when the handle is rotated 180° from the position shown in FIG. 8 and pivoted toward the housing 3 of the hair dryer 100.

Figure 9:
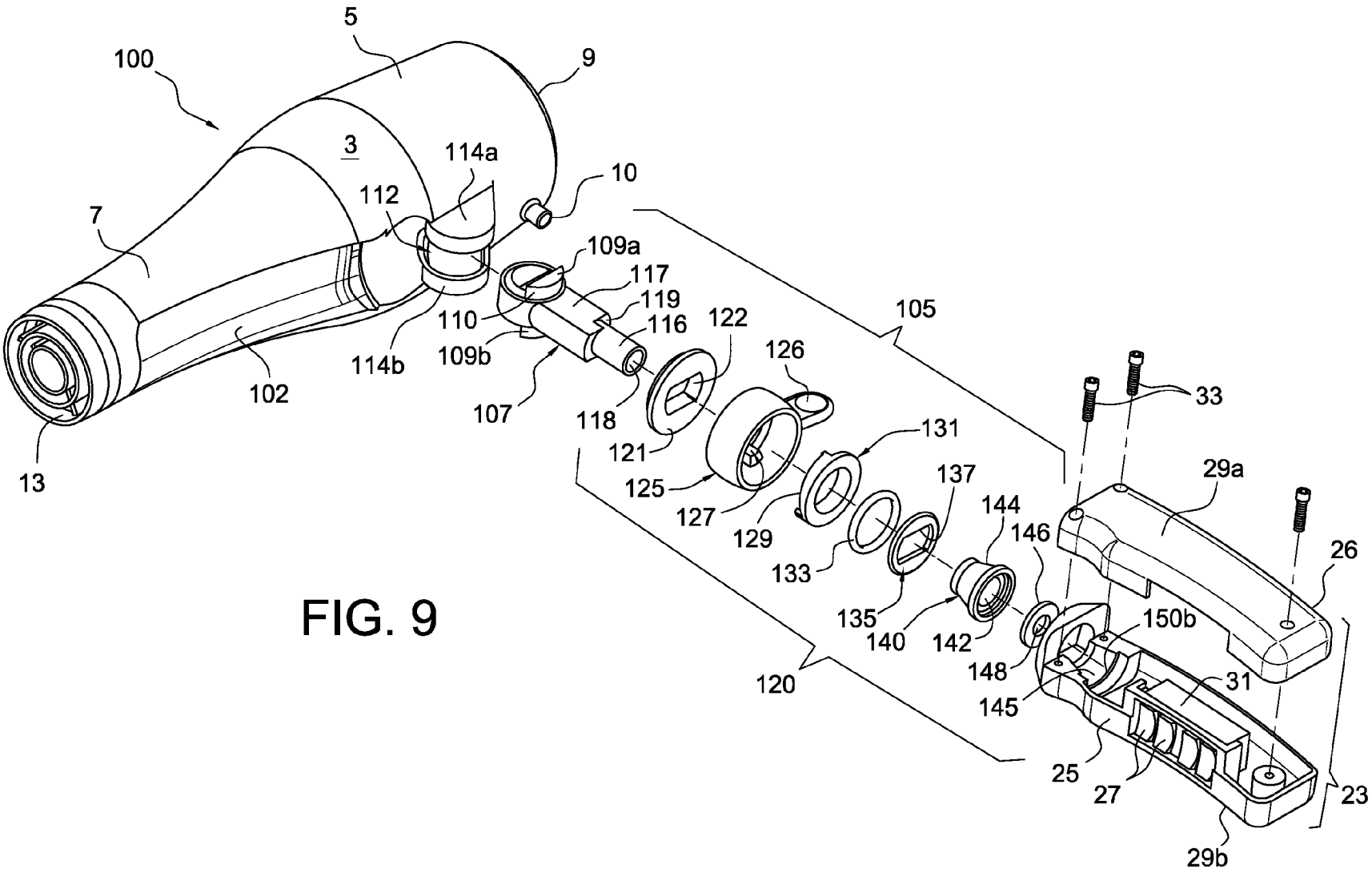
FIG. 9 is an exploded view of the hair dryer of FIG. 7 illustrating in particular the dual axis joint assembly that connects the handle to the blower assembly portion of the housing.

With reference now to FIGS. 9 and 10, the handle 23 is formed from handle halves 29*a* and 29*b* in the same manner as the first embodiment 1. A switch box 31 containing the control switches 27 is captured between the handle halves 29*a* and 29*b*, which are in turn secured together via mounting screws 33. The handle 23 is connected to the housing 3 by a dual axis joint assembly 105.

However, unlike the joint assembly 35 of the first embodiment, the joint assembly 105 of the second embodiment allows the handle to be rotated 180° with respect to the housing instead of only 90°. Moreover, the rotary movement of the handle 23 is independent of the pivoting movement of the handle. To these ends, the dual axis joint assembly of the second embodiment includes a dual axis shaft 107 best seen in FIG. 9. Dual axis shaft 107 includes opposing, partial pivot shafts 109*a*, 109*b* which implement the pivoting action of the joint assembly 105. These partial pivot shafts 109*a*, 109*b* are captured within a pivot socket 112 extending from the blower assembly portion 5 of the housing 3. Pivot socket 112 is formed from a pair of socket halves 114*a*, 114*b* as shown. While not specifically shown in the drawings, the housing 3 is formed from two halves which are fastened together by screws or the like, and the two socket halves 114*a*, 114*b* are present on opposite halves of the housing 3. The partial pivot shafts 109*a*, 109*b* are captured between the two socket halves 114*a*, 114*b* when the housing halves of the hair dryer 100 are fastened together so that the outer, arcuate surfaces 110 of the partial pivot shafts 109*a*, 109*b* frictionally engage complementary-shaped arcuate inner surfaces of the two socket halves 114*a*, 114*b* to provide a smooth pivoting action. The dual axis shaft 107 further includes a rotary shaft 166 which is rotatably mounted in the handle 23 and which implements the rotary action of the joint assembly 105. The dual axis shaft 107 further includes a midsection 117 that integrally connects the partial pivot shafts 109*a*, 109*b* to the rotary shaft 166. The midsection 117 has a non-round outer surface for "keying in" other components of the joint 105 to prevent them from rotating, as described hereinafter. The dual axis shaft 107 includes a hollow interior 118 for accommodating electrical wires 66 from the switchbox 31, as is best seen in FIG. 10. Finally, midsection 117 of the dual axis shaft 107 includes an offset 119 which cooperates with a protrusion (not shown) within the handle 23 to limit the angle of rotation of the handle relative to the housing 3 to 180°.

With reference again to FIGS. 9 and 10, the dual axis joint 105 further includes a brake mechanism 120 for simultaneously locking the handle 23 into a desired pivotal and rotational position with respect to the housing 3. To this end, the brake mechanism 120 includes a compression washer 121 having an opening 122 that slidably receives the midsection 117 of the dual axis shaft 107. The non-circular shape of the exterior of the midsection 117 prevents the compression washer 121 from rotating relative to the dual axis shaft 107. Preferably, compression washer 121 is made from nylon impregnated with a solid lubricant such as molybdenum disulfide. Disposed beneath the compression washer 121 is a compression collar 125 having a thumb wing 126 extending from its exterior. The annular interior of the collar 125 includes three flanges 127 (of which only one is visible) which slidably ride on arcuate ramps 129 which form part of a ramp ring 131. As a result of the sliding engagement between the flanges 127 and ramps 129, rotating the collar 125 counterclockwise moves the collar 125 away from the ramp ring 131 into a handle locking position, while rotating the collar 125 clockwise moves the collar 125 toward the ramp ring 131 into a handle loosening position. Located below the ramp ring 131 is a compressible spring ring 133 formed from an elastomeric material. Spring ring 133 is supported by washer 135, which, like compression washer 121, includes an opening 137 that slidably receives the midsection 117 of the dual axis shaft 107 such that the washer can move axially with respect to the midsection 117, but not rotatably. A compression collet 140 is located beneath the washer 135. Collet 140 has a cylindrical interior which rotatably receives the rotary shaft 116 of the dual axis shaft 107, and a frusto-conically-shaped exterior which is received within a frusto-conical recess 145 defined within the handle halves 29*a* and 29*b*. Finally, the brake mechanism 120 includes an end cap 146 which is glued or otherwise secured to the distal end of the rotary shaft 116 of the dual axis shaft 107. End cap 146 includes a circular opening 148 for receiving wires 66.

Figure 11A:
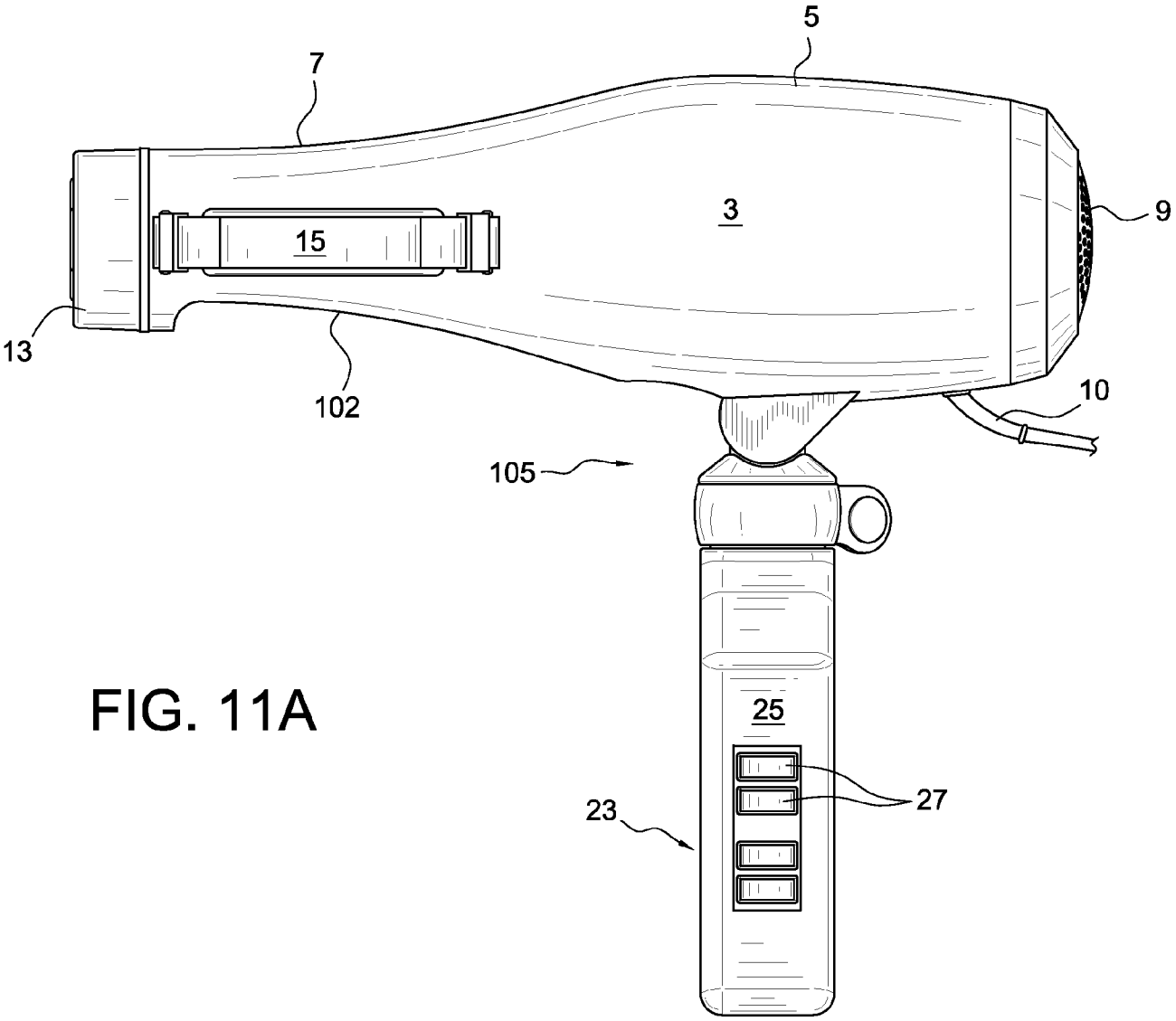
FIGS. 11A and 11B are side views of the hair dryer illustrated in FIG. 7 with the handle rotated 90° and 180°, respectively.
Figure 11B:
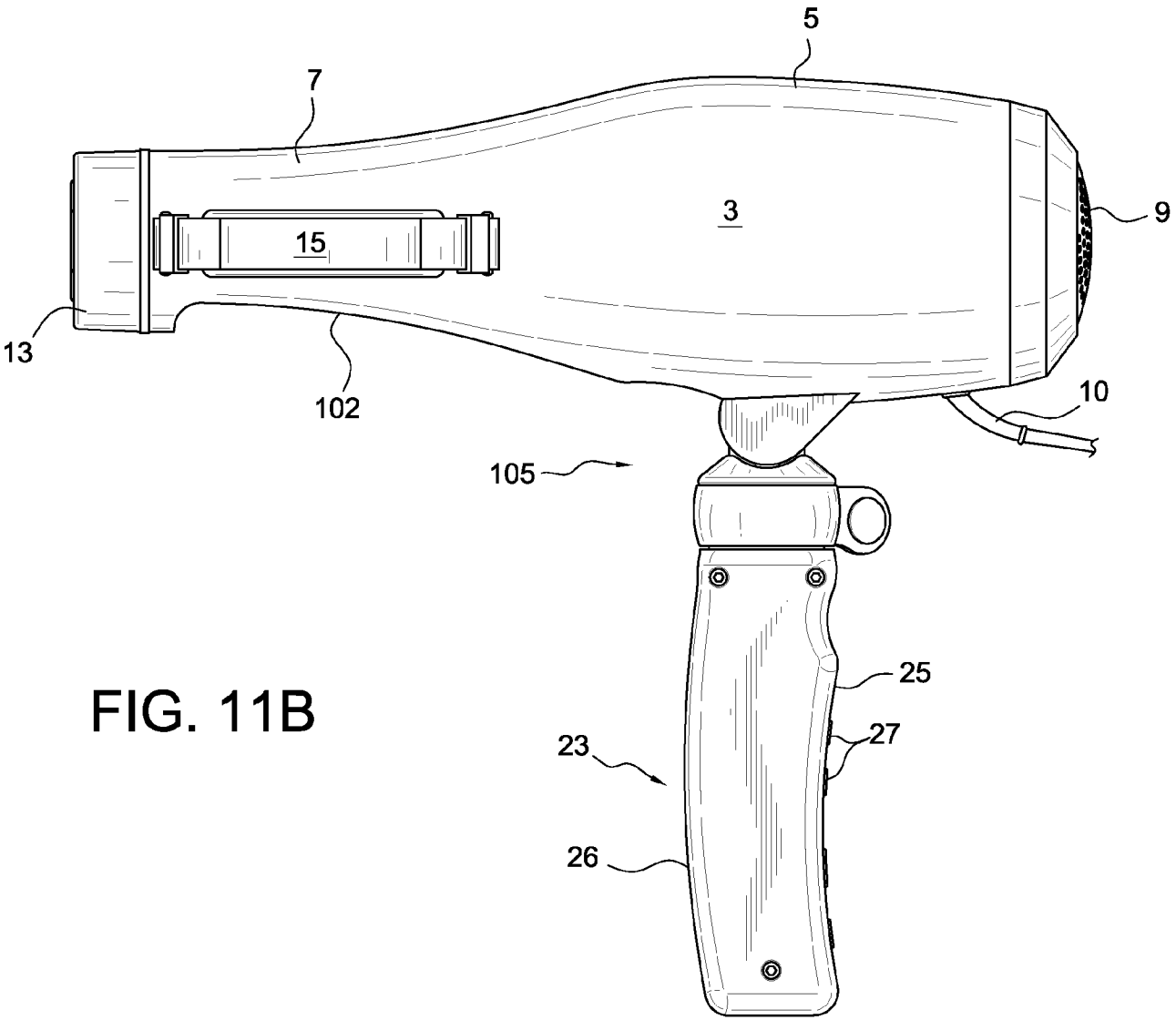
Figure 12:
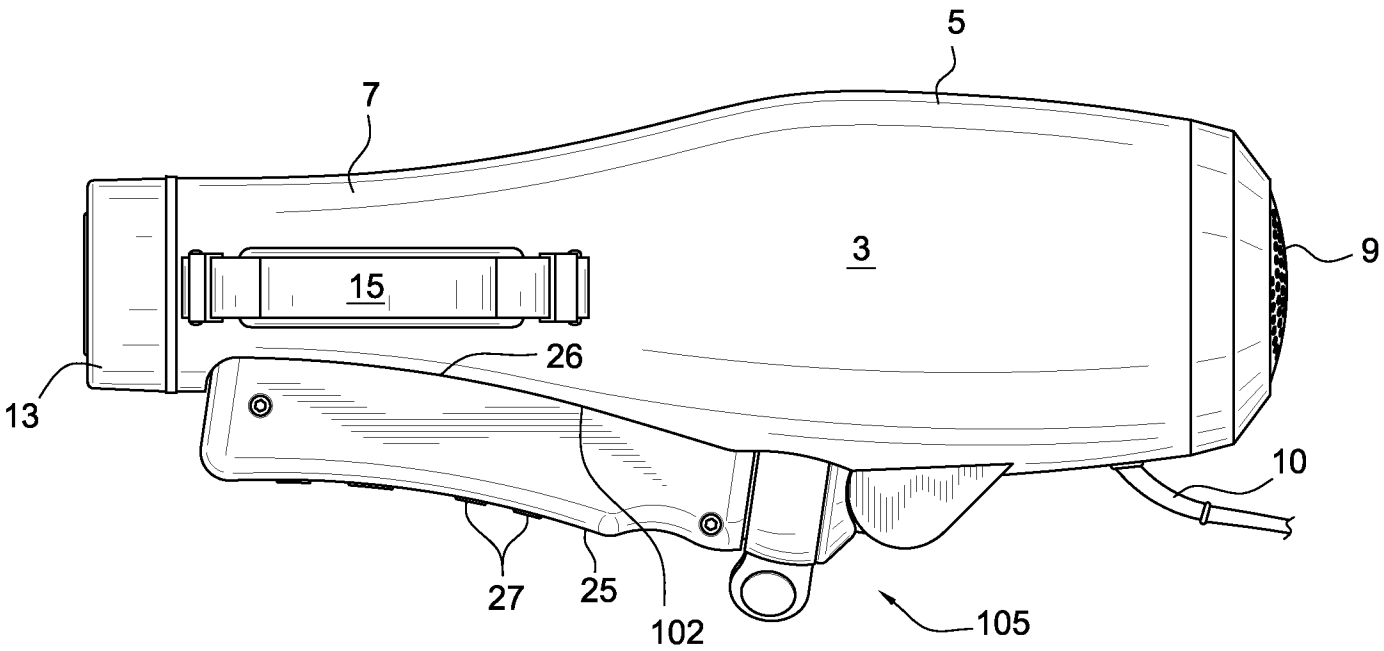
FIG. 12 is a side view of the hair dryer with the handle rotated 180° and pivotally folded toward the housing illustrating how the control switches on the handle remain accessible in preparation for a nozzle-held mode of operation.

The operation of the second embodiment 100 of the inventive hair dryer will now be explained with reference to FIGS. 9, 10, 11A, 11B and 12. FIG. 10 illustrates the hair dryer 1 in a handle-held mode of operation, wherein the longitudinal axis of the handle 23 is "locked" into an orthogonal orientation with respect to the housing 3 via the brake mechanism 120. In such a "locked" orientation, the compression collar 125 has been rotated to its maximum extent counterclockwise such that the collar 125 has been moved apart from the ramp ring 131 a maximum extent. Such axial movement of the compression collar 125 has the effect of pulling the arcuate surfaces 110 of the partial pivot shafts 109*a*, 109*b* into a locking frictional engagement with the inner surfaces of the socket halves 114*a*, 114*b*. Such axial movement also has the effect of compressing the spring ring 133, and pulling the end cap 146 at the end of the shaft 116 upwardly. The upward movement of end cap 146 forcefully wedges the conical exterior of the collet 140 against the conical walls of the recess 145, thereby radially compressing the cylindrical interior 142 of the collet into frictional locking engagement against the shaft 116. When the hair dryer 100 is to be used in a nozzle-held mode, the compression collar 125 of the brake mechanism 120 is rotated clockwise via thumb wing 126 to retract the compression collar 125 back toward the ramp ring 131 and release the locking friction applied by the brake mechanism 120 to the dual axis shaft 107. The handle 23 is then rotated 180° as illustrated in FIGS. 11A and 11B until the front face 25 of the handle 23 faces backwards. The handle 23 is then pivoted 90° toward the housing 3 until the back face 26 of the handle is received in the recess 102 in the housing 3 as shown in FIG. 12, such that the switches 27 located on the front face 25 of the handle 23 are exposed and easy to use by the operator. The operator then rotates the compression ring 120° counterclockwise to re-establish the frictional lock that the brake mechanism 120 applies to both the partial pivot shafts 109*a*, 109*b* and the rotary shaft 116 of the dual axis shaft 107. As in the first embodiment 1, the placement of the electrical cord connection 10 at the lower back of the housing 3 of the second embodiment advantageously positions the electrical cord out of the way of the operator during such a nozzle-held mode of operation.

While the invention has been described in detail with particular reference to certain preferred embodiments thereof, it will be understood that variations and modifications can be effected within the spirit and scope of the invention, which is limited only by the appended claims and equivalents thereof.

The invention claimed is:

1. A hair dryer, comprising:

a housing containing a blower assembly and including a nozzle having an open end that directs air blown by the blower assembly substantially along an axis;

an electrical cord connection mounted on the housing which orients a portion of an electrical cord that supplies power to the blower assembly in a direction parallel to and away from the nozzle wherein the electrical cord connection is mounted on the end of the housing opposite the nozzle;

an elongated handle having a control switch that controls the blower assembly, the control switch facing a same direction as the open end of the nozzle and being operable in pistol-grip fashion when the handle is in a position substantially orthogonal to the housing axis, and a dual axis joint assembly connecting the handle to the housing that includes an eccentric mechanism that causes the handle to simultaneously rotate around its longitudinal axis and pivot toward the housing when moved from said orthogonal position to a position substantially parallel to said housing axis such that the control switch turns away from said housing and is exposed and operable by a user when the handle is pivoted into said position.

2. The hair dryer defined in claim 1, wherein the dual axis joint assembly allows the handle to be rotated at least 90° such that the control switch faces away from the housing when the handle is pivoted from said orthogonal position to said position substantially parallel to said housing axis.

3. The hair dryer defined in claim 1, wherein the dual axis joint assembly includes a lock movable into a locking and an unlocking position that prevents the handle from rotating and pivoting relative to the housing when in said locking position.

4. The hair dryer defined in claim 2, further including a lock, wherein the lock is movable into a locking and an unlocking position to lock or unlock the handle at any rotational position and at any pivotal position.

5. The hair dryer defined in claim 1, wherein the dual axis joint assembly includes a rotational limiting mechanism that confines rotational movement of the handle relative to the housing to between 0° and at least 90°.

6. The hair dryer defined in claim 1 further comprising a hand strap connected to the exterior of the housing that receives the fingers of a user to facilitate the grip of a user around the housing.

7. The hair dryer defined in claim 1 wherein the eccentric mechanism includes an eccentric shaft mounted on one of the handle and the housing and a track present in one of the handle and the housing that slidably receives the eccentric shaft.

8. The hair dryer defined in claim 7, wherein the eccentric shaft is mounted on the handle and is offset from the axis of rotation of the handle and the track includes a cam slot in the housing.

9. The hair dryer defined in claim 1, wherein the dual axis joint assembly causes the handle to be rotated 180° such that the control switch faces opposite from said housing after said handle is pivoted from said orthogonal position to a position substantially parallel to said housing axis.

10. A hair dryer, comprising:

a housing containing a blower assembly and including a nozzle having an open end that directs air blown by the blower assembly substantially along an axis, and an electrical cord connection mounted away from the nozzle that supplies power to the blower assembly;

an elongated handle having a control switch that controls the blower assembly, the control switch facing a same direction as the open end of the nozzle and being operable in pistol-grip fashion when the handle is in a position substantially orthogonal to the housing axis, and a dual axis joint assembly connecting the handle to the housing that includes an eccentric mechanism that causes the handle to simultaneously rotate around its longitudinal axis, and pivot toward the housing when moved from said orthogonal position to a position substantially parallel to said housing axis such that the control switch turns away from said housing and is exposed and operable by a user when the handle is pivoted into said position substantially parallel to said housing axis, wherein the dual axis joint assembly confines rotational movement of the handle relative to the housing to between 0° and at least 90°.

11. The hair dryer defined in claim 10 wherein the dual axis joint assembly includes a lock movable into a locking and an unlocking position to lock or unlock the handle at any rotational position and at any pivotal position.

12. The hair dryer defined in claim 11 wherein the lock includes a rotatable lock ring in combination with one of a screw thread and an inclined plane that compresses relatively movable surfaces of the dual axis joint assembly together to create a braking force within the dual axis joint assembly.

13. The hair dryer defined in claim 10 further comprising a hand strap connected to the exterior of the housing that receives the fingers of a user to facilitate the grip of a user around the housing.

14. The hair dryer defined in claim 10 wherein the eccentric mechanism includes an eccentric shaft mounted on one of the handle and the housing and a track present in one of the handle and the housing that slidably receives the eccentric shaft.

15. The hair dryer defined in claim 14 wherein the eccentric shaft is mounted on the handle and is offset from the axis of rotation of the handle and the track includes a cam slot in the housing.

16. The hair dryer defined in claim 15 wherein the ends of said cam slot in the housing form said rotational limiting mechanism that confines rotational movement of the handle relative to the housing to between 0° and at least 90°.

17. The hair dryer defined in claim 10 wherein the dual axis joint assembly confines the pivoting movement of the handle to a single plane as the handle is moved to a position substantially parallel to said housing axis.

18. The hair dryer defined in claim 10 wherein the housing includes a recess that is complementary in shape to a side of said handle that is opposite from said control switch such that said handle may be rotated 180° and partially inserted into said recess when pivoted into a position substantially parallel to said housing axis.

19. The hair dryer defined in claim 1 wherein the dual axis joint assembly confines the pivoting movement of the handle to a single plane as the handle is moved to a position substantially parallel to said housing axis.

20. A hair dryer, comprising:

a housing containing a blower assembly and including a nozzle having an open end that directs air blown by the blower assembly substantially along an axis;

an elongated handle having a control switch on a front portion that controls the blower assembly, the control switch facing a same direction as the open end of the nozzle and being operable in pistol-grip fashion when the handle is in a position substantially orthogonal to the housing axis;

an electrical cord connection mounted on the end of the housing opposite the nozzle that supplies power to the blower assembly;

a dual axis joint assembly connecting the handle to the housing that includes an eccentric mechanism that causes the handle to simultaneously rotate with respect to its longitudinal axis and pivot toward the housing when moved from said orthogonal position to a position substantially parallel to said housing axis such that the control switch faces away from the housing into a position operable by a user.

21. The hair dryer defined in claim 20 further comprising a hand strap connected to the exterior of the housing that receives the fingers of a user to facilitate the grip of a user around the housing, wherein the hand strap aligns the fingertips of the user over the control switch.

22. The hair dryer defined in claim 20 wherein every control switch is located on the handle, and no electrical power cords extend from the handle.

23. The hair dryer defined in claim 22 wherein the dual axis joint assembly confines the pivoting movement of the handle to a single plane as the handle is moved to a position substantially parallel to said housing axis.

24. The hair dryer defined in claim 1 wherein the handle includes a hollow portion, the control switch includes a switch box mounted within the hollow portion of the handle, and wherein the switch box is connected to the electrical cord connection mounted on the end of the housing via electrical power wires extending through the housing and an upper part of the hollow portion of the handle such that no electrical cord connections are present on the exterior of the handle.

25. The hair dryer defined in claim 10 wherein the handle includes a hollow portion, the control switch includes a switch box mounted within the hollow portion of the handle, and wherein the switch box is connected to the electrical cord connection mounted on the end of the housing via electrical power wires extending through the housing and an upper part of the hollow portion of the handle such that no electrical cord connections are present on the exterior of the handle.

26. The hair dryer defined in claim 20 wherein the handle includes a hollow portion, the control switch includes a switch box mounted within the hollow portion of the handle, and wherein the switch box is connected to the electrical cord connection mounted on the end of the housing via electrical power wires extending through the housing and an upper part of the hollow portion of the handle such that no electrical cord connections are present on the exterior of the handle.

* * * * *